US005769602A

United States Patent [19]

Agahi et al.

[11] Patent Number: 5,769,602

[45] **Date of Patent: *Jun. 23, 1998**

[54] ACTIVE AUTOMATIC CLAMPING CONTROL

[75] Inventors: Reza R. Agahi, Granada Hills; Behrooz Ershagi, Irvine, both of Calif.

[73] Assignee: Rotoflow Corporation, Gardena, Calif.

[ * ] Notice: The term of this patent shall not extend beyond the expiration date of Pat. No. 5,564,895.

[21] Appl. No.: 731,288

[22] Filed: Oct. 11, 1996

Related U.S. Application Data

[63] Continuation of Ser. No. 427,955, Apr. 26, 1995, Pat. No. 5,564,895.

[51] Int. Cl.[6] ..... F01D 17/16

[52] U.S. Cl. ..... 415/29; 415/164

[58] Field of Search ..... 415/17, 29, 45, 415/118, 128, 163, 164

[56] References Cited

U.S. PATENT DOCUMENTS

| | | | |
|---|---|---|---|
| 2,341,974 | 2/1944 | Browne | 415/163 |
| 2,976,013 | 3/1961 | Hunter | 415/163 |
| 3,033,519 | 5/1962 | Radtke | 415/164 |
| 3,495,921 | 2/1970 | Swearingen | 415/163 |
| 4,242,040 | 12/1980 | Swearingen | 415/113 |
| 4,300,869 | 11/1981 | Swearingen | 415/160 |
| 4,502,836 | 3/1985 | Swearingen | 415/150 |
| 5,564,895 | 10/1996 | Agahi et al. | 415/29 |

FOREIGN PATENT DOCUMENTS

| | | | |
|---|---|---|---|
| 175707 | 9/1985 | Japan | 415/163 |

*Primary Examiner*—John T. Kwon
*Attorney, Agent, or Firm*—Lyon & Lyon LLP

[57] ABSTRACT

An automatic control of clamping forces in primary nozzle systems of radial turbines. Pressure to an closed annular volume positioned between a turbine housing and an axially adjustable mounting ring is varied to regulate the clamping forces against inlet vanes which form primary nozzles. A controller compares process control data with a signal indicative of operational deviation from nominal operation as indicated by the process control signal to detect onset of excessive blow-by, in which case pressure is increased in the closed annular volume to move the mounting rings closer together. The controller also compares expected and actual system data to detect onset of excessive clamping, in which case pressure is increased in the closed annular volume to increase clamping forces.

8 Claims, 3 Drawing Sheets

ACTIVE AUTOMATIC CLAMPING CONTROL

This is a continuation of U.S. patent application Ser. No. 08/427,955, filed Apr. 26, 1995, issuing on Oct. 15, 1996 as U.S. Pat. No. 5,564,895.

BACKGROUND OF THE INVENTION

The field of the present invention is radial inflow turbines, also known as turboexpanders, and more specifically, variable primary nozzle systems of radial inflow turbines.

Radial turbines employ an annular inlet surrounding a turbine wheel through which is directed influent under pressure. To uniformly distribute the influent, primary, stationary vanes are disposed about the annular inlet to create a nozzle therebetween. These nozzles are often variable through the controlled pivotal motion of the primary vanes.

The primary vanes are typically mounted between mounting rings. One of the mounting rings may be pivotally mounted relative to the other mounting ring which is then employed as a means for pivoting the vanes. The mounting rings are also mounted for relative axial movement therebetween. Normally, one ring is fixed while the other is allowed to move axially to accomplish this result. Typically, a pneumatic or hydraulic cylinder is associated with the pivotal mounting ring to forcefully control the position of the mounting ring, in turn controlling the vanes. One such system is presented in U.S. Pat. No. 3,495,921 directed to Variable Nozzle Turbine, the disclosure of which is incorporated herein by reference.

Because of the inherent pressures in such radial turbines, particularly the static and dynamic pressures of the flow through the primary nozzle, clamping forces are applied by the mounting rings to the sides of the vanes adjacent the mounting rings if one or both of the rings is axially movable. A close fit of the rings about the vanes prevents the occurrence of "blow-by," i.e. direct leakage flow from inlet to outlet, bypassing the nozzle and reducing turbine efficiency. However, the resulting clamping forces often can become excessive, and actuation of the vanes to adjust the nozzle is inhibited.

A method of attempting to control clamping forces is disclosed in U.S. Pat. No. 4,502,836, directed to Method For Nozzle Clamping Force Control, the disclosure of which is incorporated herein by reference. In the referenced patent, a fluid pressure driven actuator system, driven by two supply lines, varies the pressure to an annular space adjacent a mounting ring. During steady state operation, the nozzle is clamped by the associated mounting rings. When pressure builds in the actuator system for adjusting the nozzle, the annular space is pressurized to overcome the clamping force. See also earlier U.S. Pat. Nos. 4,242,040 and 4,300,869, the disclosures of which are incorporated herein by reference.

SUMMARY OF THE INVENTION

The present invention is directed to the control of clamping forces in primary nozzle systems of radial turbines. More specifically, the present invention is directed to automatic control of clamping forces of adjustable mounting rings in response to data measured from the operational turbine and process systems.

In the present invention, transmitters continuously measure and communicate process system and nozzle system data to a controller. The controller processes received data, detects the onset of inefficient clamping conditions, and automatically initiates corrective actions.

Accordingly, it is a principal object of the present invention to provide an automatic control over the clamping forces on a variable nozzle system in a radial turbine. Other and further objects and advantages will become apparent hereinafter.

DETAILED DESCRIPTION OF THE PREFERRED EMBODIMENT

Figure 1:
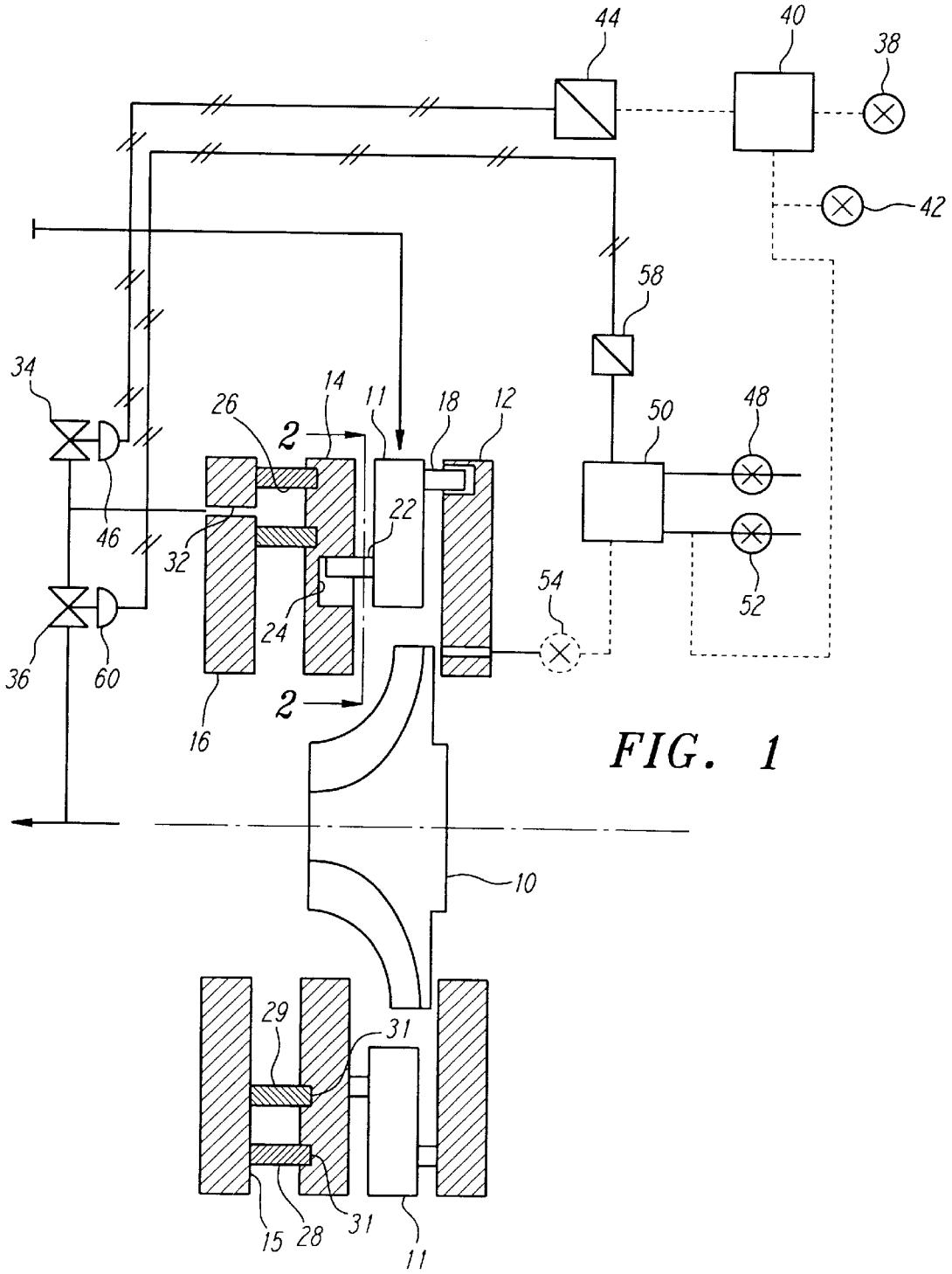
FIG. 1 is a schematic cross-sectional view of a variable nozzle system.

Turning in detail to the drawings, a portion of a variable nozzle arrangement to a radial inflow turbine 10 is illustrated. In FIG. 1, the variable primary nozzle system includes a number of pivotally mounted inlet vanes 11 located between mounting rings 12 and 14 in an annular inlet 15. The mounting rings 12 and 14 are mounted to the body 16 of the radial turbine. The mounting ring 12 is fixed while the mounting ring 14 is both pivotally and axially movable relative to the body 16.

Figure 2:
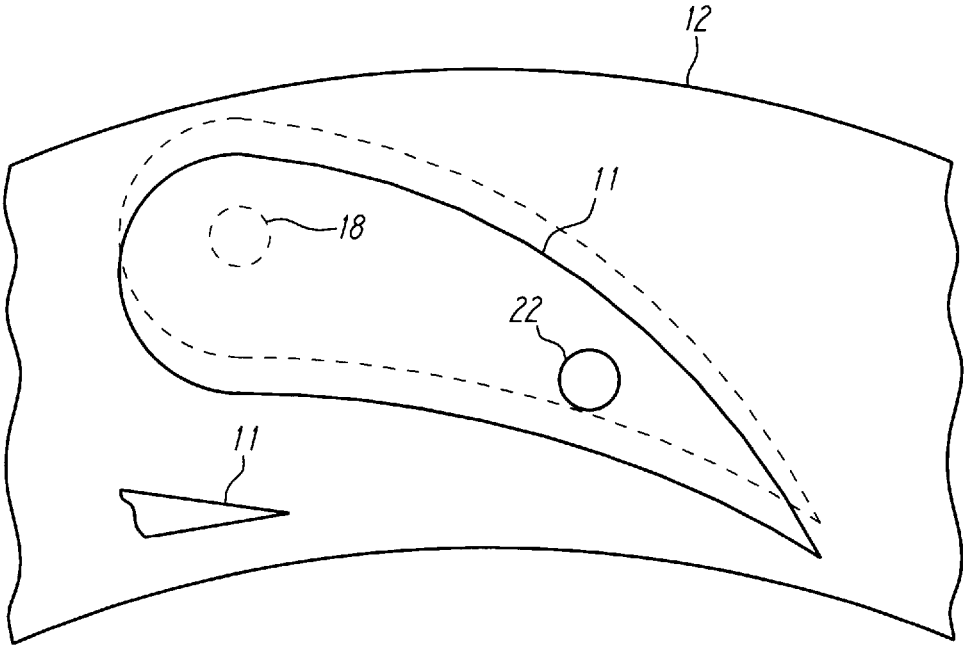
FIG. 2 is a side view taken elevation along line 2—2 of FIG. 1.

To operatively mount the pivotal inlet vanes 11 between the mounting rings 12 and 14, each vane 11 is associated with a first pin 18 extending between the mounting ring 12 and the vane 11 so that the vane 11 may pivot relative to the ring 12. A second pin 22 extends between each vane 11 and the mounting ring 14 at a position displaced laterally from the first pin 18. This second pin 22 is accommodated in one of the ring 14 and the vane 11 by a slot 24. Each slot 24 is angled such that rotation of the mounting ring 14 relative to the mounting ring 12 will result in the second pin 22 moving through the slot 24 to rotate the pivotal vane 11 about the axis of the first pin 18. With all vanes 11 identically configured, the nozzle cross-sectional area may be varied as the leading portion of each pivotal vane 11 approaches or withdraws from the trailing end of the adjacent vane 11. FIG. 2 employs phantom lines to illustrate the pivotal capability of the vanes 11.

The mounting ring 14 is mounted such that it can move axially. Thus, relative axial movement between the mounting rings 12 and 14 can occur to result in closing or opening of the spaces between the vanes 11 and the mounting rings 12 and 14. As a result of the sum of all pressures acting on the mounting rings 12 and 14, spacing between the vanes 11 and the mounting rings 12 and 14 can reach extremes, leading to inefficient operation of the variable primary nozzle system.

When the mounting rings 12 and 14 are spaced too closely together, a condition of excessive clamping occurs which restricts the pivotal movement of the vanes 11, thereby defeating the variability feature of the nozzle system. When the mounting rings 12 and 14 are spaced too far apart, a phenomenon known as "blow-by" occurs where influent leaks through the system without being channeled through the nozzles. Because of these conditions which affect nozzle system efficiency, it is advantageous to continuously and actively monitor and control the spacing between the vanes 11 and the mounting rings 12 and 14.

Differing pressures within the radial turbine are employed to control the clamping forces of the mounting rings 12 and 14 on the vanes 11. The side of the adjustable mounting ring 14 adjacent the vanes 11 is exposed to a variable pressure distribution ranging from an existing higher pressure source of process gas at the nozzle system inlet, to a resultant lower pressure source of process gas at the nozzle system outlet. The back side of the adjustable mounting ring 14 facing away from the vanes 11 is partially exposed to nozzle system inlet pressure and partially exposed to nozzle system outlet pressure.

An axially extendable annular chamber forming a closed annular volume 26 separates the two pressure levels exposed to the back side of the adjustable mounting ring 14. The closed annular volume 26 is formed between two concentric sealing rings 28 and 29, spaced concentrically, and positioned between the adjustable mounting ring 14 and the most adjacent portion of the radial turbine body 16. The sealing rings 28 and 29 are made of PTFE, or other such resilient sealing material capable of maintaining its sealing properties throughout the range of relative axial motion of the mounting rings 12 and 14. The material used for the sealing rings 28 preferably is selected to resist corrosive components in the process gas and to endure the conditions during operation such as temperature and level of pressure. The material selected should also have a low friction coefficient.

The diameter of the closed annular volume 26 is calculated such that the normal pressure forces acting on both sides of the adjustable mounting ring 14 are equal, thereby maintaining its position. However, slight deviations in process conditions, minor erosion of the vanes 11, and many other unavoidable abnormalities produce pressure fluctuation, and thus the pressure forces acting on the adjustable mounting ring 14 cease to be balanced.

The sealing rings 28 and 29 are set into channels 31 shown in FIG. 1 in the back of the mounting ring 14. The channels 31 could alternatively or additionally be found in the most adjacent portion of the radial turbine body 16. Depending on the resilience of the material forming the rings 28 and 29 and the amount of movement afforded the mounting ring 14, the sealing rings 28 and 29 may be fixed within the channels 31 or resiliently mounted to move with the relative movement between the clamping ring 14 and the most adjacent portion of the radial turbine body 16. The sealing rings 28 and 29 may be fixed to one or the other of the back of the mounting ring 14 and the portion of the radial turbine body 16 and allowed to slide in the channels 31.

Control of the movable mounting ring 14 in the axial direction is performed by monitoring certain operational parameters. When a deviation is sensed, the pressure within the closed annular volume 26 is adjusted to regain equilibrium. A passageway 32 extends from the closed annular volume 26 through the turbine body portion to a valve mechanism having both a high pressure control valve 34 and to a low pressure control valve 36. Nozzle system inflow is connected to the high pressure control valve 34 to provide a source of high pressure inflow to the closed annular volume 26, while either nozzle system discharge or atmosphere may be connected to the low pressure control valve 36 to provide a low pressure vent from the closed annular volume 26.

To increase the clamping force of the mounting rings 12 and 14, the inlet control valve 34 is actuated to increase the pressure within the closed annular volume 26, resulting in axial motion of the mounting ring 14 toward the vanes 11 and the mounting ring 12. To decrease the clamping force of the mounting rings 12 and 14, the outlet control valve 36 is actuated to reduce the pressure within the closed annular volume 26, resulting in axial motion of the mounting ring 14 away from the vanes 11 and the mounting ring 12.

Detection of clamping conditions is performed by continuously monitoring and comparing system parameters which are physically related. Two mechanisms are used, one for measuring excessive clamping and the other for measuring excessive blow-by.

To detect excessive blow-by, a nozzle position transmitter 38 continuously measures nozzle position. This position corresponds to the angular position of the ring 14 which determines vane orientation and, in turn, determines nozzle cross-sectional area. Nozzle position is determined by turbine wheel speed; and the nozzle position is accurately maintained in this circumstance because, with excessive blow-by, the rings 12 and 14 are not clamped against the vanes 11. Thus, the signal of the nozzle position transmitter 38 is also characteristic of the turbine wheel speed of the device. This signal is presented to a controller 40.

Also presented to the controller 40 is a process control signal from a process control signal transmitter 42. The transmitter 42 continuously measures one of a group of possible system parameters normally employed in such devices for process control. Examples of such system parameters available are turboexpander upstream pressure, turboexpander downstream pressure, process fluid pressure spatially distanced from the turboexpander, turboexpander inlet flow, and knockout drum pressure. System variables which represent unbalanced clamping forces (creating either blow-by or excessive clamping) reflective of the parameters which can be measured are warmer than normal expander discharge temperatures, lower than normal rotational speeds, higher than normal expander inlet pressures when process conditions have not changed, lower than normal expander inlet pressures when process conditions have not changed and lower than normal expander output power.

Figure 3:
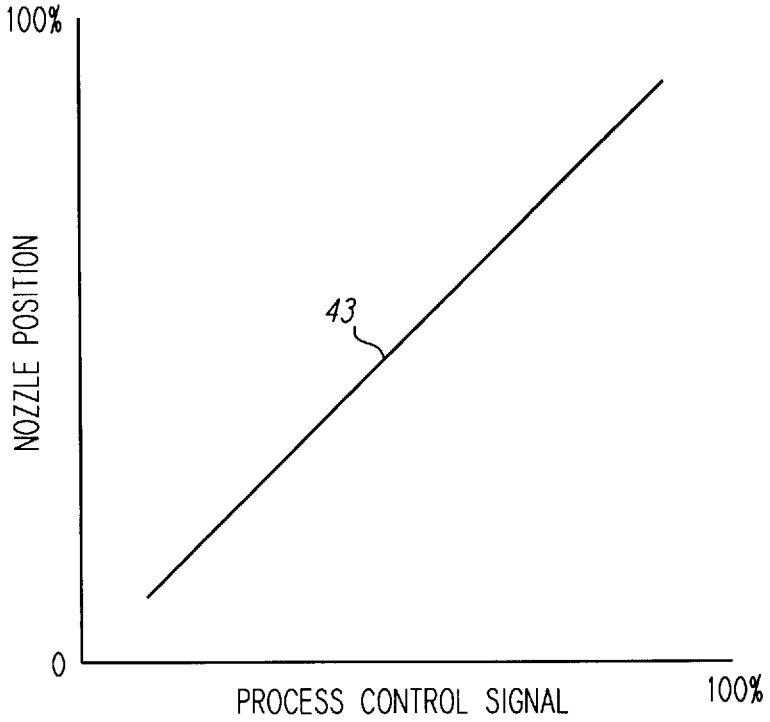
FIG. 3 graphically represents the linear relationship between nozzle position of a variable nozzle system and a process control signal.

The signals from the nozzle position transmitter 38 and the process control signal transmitter 42 presented to the controller 40 are linearly related as shown by example as line 43 in FIG. 3 for given operating conditions. The exact relationship is determined by the process control signal. When excessive blow-by is experienced, turbine speed drops below expectations based on the process control signal. This, in turn, adjusts the nozzle position such that the linear relationship is not maintained and actually falls below the curve of FIG. 3. The controller 40 compares the values it receives from both of the transmitters 38 and 42 to determine whether the two values fit the curve defined. If the nozzle position is more closed than expected, excessive blow-by is indicated.

Under the sensed condition of excessive blow-by, the controller 40 presents a command to an electronic-to-pneumatic signal converter 44. The converter 44 pneumatically activates the actuator 46 of the outlet control valve 34. This increases the pressure in the closed annular volume 26, moving the ring 14 toward the vanes 11 and reducing the blow-by.

Detection of excessive clamping is performed by comparing expected and actual values of process gas pressure $P_r$ between nozzle discharge and entry into the turbine wheel 10. To define expected values of the process gas pressure at the turbine wheel entry, a number of parameters are monitored. An expander inlet pressure transmitter 48 continuously measures the pressure $P_1$ of inlet process gas and electronically communicates the measurement to a controller 50. This measurement is taken upstream of the vanes 11.

Similarly, an expander outlet pressure transmitter 52 continuously measures the pressure $P_2$ of the process gas discharged from the turbine wheel 10 and electronically communicates the measurement to the controller 50. The process control transmitter 42 electronically communicates the measured process control variable to the controller 50 or the nozzle position transmitter 38 electronically communicates the position signal of where the nozzle is commanded to be set. As the vanes 11 of the nozzle are clamped and cannot move in an excessive clamping situation, the actual nozzle position is not where the signal indicates. Until the excessive clamping is released, the nozzle actuator cannot respond to the nozzle position signal to adjust the nozzle. Either the process control transmitter 42 or the nozzle position transmitter 38 may be used as they have a linear relationship which can be accommodated by the controller 50. Finally, a nozzle discharge pressure transmitter 54 measures the actual process gas pressure $P_r$ between nozzle discharge and entry into the turbine wheel 10.

Figure 4:
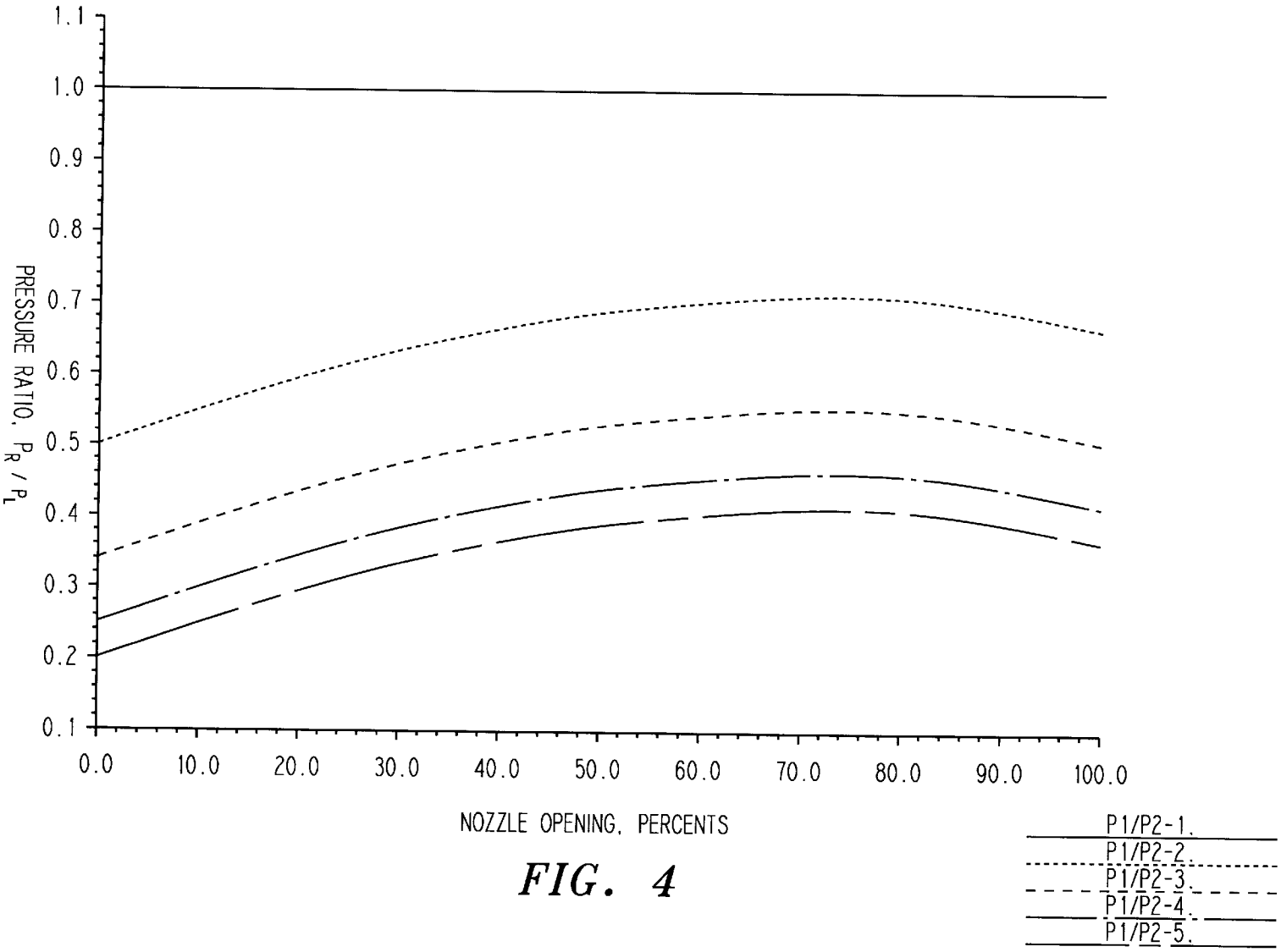
FIG. 4 graphically represents the family of curves between nozzle position and a ratio of pressures $P_r/P_1$ across the nozzle.

At the controller, a ratio of expander outlet pressure $P_2$ to expander inlet pressure $P_1$ is calculated which then establishes which of a family of curves defines the relationship between nozzle opening and the pressure ratio $P_r/P_1$ across the nozzle. Examples of such curves are illustrated in FIG. 4. From the appropriate curve and the nozzle or process control signal, the ratio of expected pressures across the nozzle can be determined. As the pressure $P_1$ of inlet process gas is provided, the expected pressure $P_r$ can be determined. The expected pressure $P_r$ is then compared by the controller 50 with the actual pressure $P_r$; and any deviation beyond a threshold signals that the nozzle is not properly positioned and the clamping forces are excessive.

With an appropriate deviation, the controller 50 electronically communicates a signal to an electronic-to-pneumatic signal converter 58. This pneumatically activates the actuator 60 of the inlet control valve 36 to allow decreased pressure in the closed annular volume 26 alleviating an excessive clamping condition.

While the foregoing disclosure speaks of separate controllers to detect and control excessive clamping, and to detect and control "blow-by" for simplicity of explanation, single complex controller may perform both functions.

Thus an active automatic clamping control is described for the variable nozzles of a radial turbine. While an embodiment and application of this invention have been shown and described, it would be apparent to those skilled in the art that many more modifications are possible without departing from the inventive concepts. The invention, therefore, is not to be restricted except in the spirit of the appended claims.

What is claimed is:

1. A variable nozzle system for a radial inflow turbine having an annular inlet with opposed sides to a turbine wheel, comprising pivotally mounted inlet vanes in the annular inlet;

a mounting ring in the annular inlet, coupled with and adjacent to the inlet vanes, the mounting ring being moveable axially toward and away from the inlet vanes;

an axially extendable annular chamber between the mounting ring and one of the sides of the annular inlet and on the other side of the mounting ring from the inlet vanes;

a control system including a passageway to the annular chamber, a valve mechanism in communication with the passageway controlling pressure in the annular chamber, a process control signal, a signal indicative of operational deviation from nominal operation as indicated by the process control signal, and a controller determining the relationship between the process control signal and the signal indicative of operational deviation and coupled to actuate the valve mechanism responsive to determination of selected relationships between the process control signal and the signal indicative of operational deviation indicating improper axial positioning of the mounting ring at the inlet vanes in the annular inlet.

2. The variable nozzle system of claim 1, the process control signal being selected from the group consisting of a turbine inlet pressure signal, a turbine outlet pressure signal, a process fluid pressure signal spatially distanced from the radial inflow turbine and proportional to one of turbine inlet pressure and turbine outlet pressure, an inlet to the turbine flow signal, or a knockout drum pressure signal.

3. The variable nozzle system of claim 1, the signal indicative of operational deviation including a first signal indicating blow-by and a second signal indicating excessive clamping force at the inlet vanes in the annular inlet.

4. The variable nozzle system of claim 1, the signal indicative of operational deviation being selected from the group consisting of a nozzle position signal, a turbine wheel speed signal, a turbine discharge temperature signal, a differential turbine inlet pressure signal or a turbine power output signal.

5. A method for actively controlling clamping forces in a variable primary nozzle system of a radial turbine having a turbine wheel, the variable primary nozzle system having a primary nozzle formed by pivotal inlet vanes between opposed sides with an axially movable mounting ring between one side and the vanes, comprising measuring a process control system of the turbine;

measuring a signal indicative of operational deviation from nominal operation as indicated by the process control signal;

comparing the process control signal and the signal indicative of operational deviation from nominal operation;

regulating the pressure to one side of the mounting ring responsive to the comparison of the process control signal and the signal indicative of operational deviation from nominal operation.

6. The method of claim 5, measuring the process control signal including measuring a signal selected from the group consisting of a turbine inlet pressure signal, a turbine outlet pressure signal, a process fluid pressure signal spatially distanced from the radially inflow turbine and proportional to one of turbine inlet pressure and turbine outlet pressure, an inlet to the turbine flow signal, or a knockout drum pressure signal.

7. The method of claim 5, measuring the signal indicative of operational deviation from nominal operation including measuring a first signal indicating blow-by and a second signal indicating excessive clamping force at the inlet vanes.

8. The method of claim 5, measuring the signal indicative of operational deviation from nominal operation including measuring a signal selected from the group consisting of a nozzle position signal, a turbine wheel speed signal, a turbine discharge temperature signal, a differential turbine inlet pressure signal or a turbine power output signal.

* * * * *